US010046842B2

(12) United States Patent
Mizutani

(10) Patent No.: US 10,046,842 B2
(45) Date of Patent: Aug. 14, 2018

(54) OUTBOARD MOTOR MOUNTING STRUCTURE AND OUTBOARD MOTOR VESSEL PROVIDED THEREWITH

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/346,789

(22) Filed: Nov. 9, 2016

(65) Prior Publication Data

US 2017/0129577 A1 May 11, 2017

(30) Foreign Application Priority Data

Nov. 11, 2015 (JP) ..... 2015-221419

(51) Int. Cl.

| | |
|---|---|
| ***B63H 20/00*** | (2006.01) |
| ***B63H 20/02*** | (2006.01) |
| ***B63H 20/08*** | (2006.01) |
| ***B63H 20/10*** | (2006.01) |
| ***B63H 20/06*** | (2006.01) |

(52) U.S. Cl.

CPC ..... *B63H 20/10* (2013.01); *B63H 20/06* (2013.01); *B63H 2020/003* (2013.01)

(58) Field of Classification Search

CPC ..... B63H 20/10; B63H 20/06; B63H 20/08; B63H 2020/003; B63H 2020/103

USPC ..... 440/53, 77

See application file for complete search history.

(56) References Cited

U.S. PATENT DOCUMENTS

| | | | | |
|---|---|---|---|---|
| 4,969,847 | A * | 11/1990 | Curtis | B63H 20/001 123/195 P |
| 6,200,175 | B1 * | 3/2001 | Natsume | B63H 20/08 440/2 |
| 6,257,940 | B1 * | 7/2001 | Dunham | F02B 61/045 440/113 |
| 8,192,241 | B2 * | 6/2012 | Tanaka | F02M 37/0017 440/88 F |
| 8,858,280 | B1 | 10/2014 | Wiegele et al. | |

(Continued)

FOREIGN PATENT DOCUMENTS

JP 2008-087555 A 4/2008

*Primary Examiner* — Anthony D Wiest

(74) *Attorney, Agent, or Firm* — Keating and Bennett, LLP

(57) ABSTRACT

An outboard motor mounting structure mounts an outboard motor body on a hull and includes a mounting bracket fixed to the hull, a swivel bracket joined to the mounting bracket to be tiltable around a tilt axis and that supports the outboard motor body, a flexible connector, and a first connector support that supports the flexible connector at a support position in a region adjacent to the mounting bracket. The relative position of the support position with respect to the mounting bracket does not change depending on a tilt angle of the outboard motor body. The flexible connector includes at least one of a wire, an operating cable, and a pipe that connects equipment on the hull and equipment provided in the outboard motor body. The adjacent region is a region defined between an upper surface of the hull and the engine cover and between a lowest point of the engine cover and the tilt axis in a state that the outboard motor body is tilted up at a maximum tilt angle.

17 Claims, 9 Drawing Sheets

(56) References Cited

U.S. PATENT DOCUMENTS

| | | | | |
|---|---|---|---|---|
| 9,033,752 | B2 * | 5/2015 | Takase | B63H 20/10<br>440/63 |
| 2015/0093947 | A1 | 4/2015 | Nanjo et al. | |

* cited by examiner

OUTBOARD MOTOR MOUNTING STRUCTURE AND OUTBOARD MOTOR VESSEL PROVIDED THEREWITH

BACKGROUND OF THE INVENTION

1. Field of the Invention

The present invention relates to a mounting structure to mount an outboard motor body on a hull, and relates to an outboard motor vessel provided with the mounting structure.

2. Description of the Related Art

An outboard motor vessel includes a hull, an outboard motor body mounted on the hull, and an outboard motor mounting structure to mount the outboard motor body on the hull. The outboard motor mounting structure includes a mounting bracket that is fixed to the hull, a swivel bracket tiltable around a tilt shaft with respect to the mounting bracket, and a rigging hose. The rigging hose contains flexible connectors, such as operating cables, power cables, signal cables, or fuel hoses, (which are hereinafter referred to simply as "cables" for convenience). The operating cable is a cable that transmits the operating force of an operating device, such as a steering wheel or a shift/acceleration lever, to the outboard motor body. The power cable is an electric cable that connects a battery disposed on the hull and the outboard motor body together. The signal cable is an electric cable by which remote controls and meters that are provided at a navigator seat are connected to the outboard motor body in order to transmit control signals or detection signals. The fuel hose is a hose through which fuel is supplied to the outboard motor body from a fuel tank provided on the hull.

The outboard motor body is attached to the swivel bracket so as to be turnable in a left-right direction. The outboard motor body includes an engine, an engine cover (cowling), a propeller that is rotated by the driving force of the engine, and a driving force transmission that transmits the driving force of the engine to the propeller. The outboard motor includes the outboard motor body, the mounting bracket, and the swivel bracket. Therefore, the outboard motor vessel includes the hull, the outboard motor, and the cables that connect these elements together.

The mounting bracket is fixed to, for example, a stern plate of the outboard motor. A concave portion that is called a motor well is provided on an upper surface of the hull in front of the stern plate, and the rigging hose is joined to a front wall of the motor well. The cables contained in the rigging hose are inserted into the hull through the rigging hose, and extend throughout the hull.

As disclosed in U.S. Pat. No. 8,858,280, particularly FIG. 11, in a typical conventional technique, a rigging-hose mount is disposed at the front of the engine cover, and the rigging hose extends forwardly from the rigging-hose mount.

The front of the engine cover enters the motor well when the outboard motor body is tilted up by turning the swivel bracket around the tilt shaft. As a result, a large tilt angle is realized. On the other hand, the rigging hose moves inside the motor well when the outboard motor body is tilted up and down by being turned up and down and when the vessel is steered by turning the outboard motor body rightwardly and leftwardly. Thus, the connection between the hull and the outboard motor body by use of the cables is maintained while allowing the outboard motor body to turn upwardly, downwardly, leftwardly, and rightwardly. For this purpose, the rigging hose is not designed to connect the outboard motor body and the hull with the shortest distance therebetween, but is designed to secure a length longer than the shortest distance, so that room for tilting and steering is provided.

SUMMARY OF THE INVENTION

The inventor of preferred embodiments of the present invention described and claimed in the present application conducted an extensive study and research regarding an outboard motor mounting structure, such as the one described above, and in doing so, discovered and first recognized new unique challenges and previously unrecognized possibilities for improvements as described in greater detail below.

The motor well is designed to define a space large enough to allow the rigging hose to remain in the motor well even if the rigging hose moves. Therefore, the motor well becomes large in size in a plan view, and, according to circumstances, the motor well also becomes large in depth. A large-sized motor well reduces the strength of a hull structure near its stern, and a large amount of labor and great cost are required to design and produce a hull because the hull structure becomes complicated. Additionally, the large-sized motor well compresses the residence space on the hull, or prevents a reduction in the size of the hull. Without being limited only to this, a rigging hose that is sufficient in length is exposed, and moves in response to the operation of the outboard motor body, and therefore there is a concern that the exterior of the outboard motor vessel will be impaired.

In order to overcome the previously unrecognized and unsolved challenges described above, a preferred embodiment of the present invention provides an outboard motor mounting structure to mount an outboard motor body on a hull. The outboard motor body includes an engine and an engine cover with which the engine is covered. The outboard motor mounting structure includes a mounting bracket that is fixed to the hull, a swivel bracket that is joined to the mounting bracket so as to be tiltable around a tilt axis and that supports the outboard motor body, a flexible connector, and a first connector support that supports the flexible connector at a support position set in a region adjacent to the mounting bracket. The relative position of the support position with respect to the mounting bracket does not change depending on a tilt angle of the outboard motor body. The flexible connector includes at least one of a wire, an operating cable, and a pipe that connects a piece of equipment on the hull and a piece of equipment provided in the outboard motor body. The adjacent region is a region defined between a lowest point of the engine cover in a state that the outboard motor body is tilted up with a maximum tilt angle and the tilt axis, and between an upper surface of the hull and the engine cover.

According to this arrangement, the mounting bracket is fixed to the hull. The swivel bracket is tiltably joined to the mounting bracket. Therefore, the outboard motor body is tiltable together with the swivel bracket with respect to the hull.

On the other hand, a piece of equipment on the hull and apiece of equipment provided in the outboard motor body are connected together by a flexible connector including at least one of a wire, an operating cable, and a pipe. The flexible connector is supported by the first connector support at a support position in a region adjacent to the mounting bracket. The support position does not change depending on a tilt angle of the outboard motor body. Therefore, even when the outboard motor body is tilted, substantial displacement of the flexible connector on the hull side from the support position does not occur. In other words, an influence upon the flexible connector caused by the fact that the outboard motor body is tilted is prevented at the support position.

Therefore, there is no need to provide the hull with a large space (motor well) considering the displacement of the flexible connector resulting from the operation of the outboard motor body. Moreover, in the present preferred embodiment, the adjacent region in which the support position of the flexible connector by which the first connector support is located is a region defined between the upper surface of the hull and the engine cover between a lowest point of the engine cover fixed when the outboard motor body is tilted up with a maximum tilt angle and the tilt axis. The lowest point of the engine cover and the tilt axis fix the boundary of the "adjacent region" mainly concerning the front-rear direction of the hull. The upper surface of the hull and the engine cover fix the boundary of the "adjacent region" mainly concerning the up-down direction of the hull.

As a result, the position of the flexible connector is fixed at a place fairly near or adjacent to the mounting bracket, and therefore a movable region in which the flexible connector moves in response to the operation of the outboard motor body outside the outboard motor body hardly exists. This makes it possible to reduce a space required to dispose the flexible connector on the hull side. This makes it possible to increase the strength of a hull structure, and makes it possible to facilitate the design and production of the hull. Additionally, it becomes possible to widen an inboard residence space and to reduce the hull in size. Additionally, there is no need to design the flexible connector to be longer considering the operation of the outboard motor body, and a movable region of the flexible connector in response to the operation of the outboard motor body hardly exists outside the outboard motor body, and therefore it is possible to provide an outboard motor mounting structure that has good visual quality.

In a preferred embodiment of the present invention, the first connector support supports the flexible connector at the support position set in front of the mounting bracket. According to this arrangement, the support position of the flexible connector is placed in front of the mounting bracket. Therefore, it never becomes difficult to attach the flexible connector to the first connector support. Therefore, it is possible to facilitate the attaching operation of the flexible connector, and it is possible to reduce a disposition space for the flexible connector on the hull side, and it is possible to provide an outboard motor mounting structure having a good-looking exterior.

In a preferred embodiment of the present invention, the first connector support includes a stay fixed to the mounting bracket. According to this arrangement, the flexible connector is fixed to the mounting bracket through the stay, and therefore there is no need to provide the first connector support on the hull. As a result, it becomes easier to design and produce the hull.

In a preferred embodiment of the present invention, the first connector support supports the flexible connector at the upper surface of the hull. According to this arrangement, the flexible connector is supported at the upper surface of the hull, and therefore it becomes easy to attach the flexible connector to the first connector support.

In a preferred embodiment of the present invention, the outboard motor mounting structure further includes a hose that contains the flexible connector, and the first connector support supports the hose. According to this arrangement, the flexible connector is contained in the hose, and this hose is supported by the first connector support. Therefore, it is possible to reduce a disposition space for the flexible connector on the hull while supporting the flexible connector through the hose, and it is possible to provide an outboard motor mounting structure having a good-looking exterior.

The hose may contain a plurality of connectors lumped together. This makes it possible to support the flexible connectors more easily, and makes it possible to provide an outboard motor mounting structure having a good-looking exterior.

In a preferred embodiment of the present invention, the outboard motor mounting structure further includes a second connector support that supports the flexible connector along the swivel bracket. According to this arrangement, the flexible connector is supported by the second connector support along the swivel bracket, and therefore the flexible connector responds to the operation of the swivel bracket on the outboard motor-body side with respect to the first connector support. Therefore, the flexible connector responds to the operation of the outboard motor body that turns (tilts) up and down together with the swivel bracket. This makes it possible to reliably maintain a connection between the flexible connector and the outboard motor body regardless of the operation of the outboard motor body while supporting the flexible connector at a support position fixed by the first connector support.

In a preferred embodiment of the present invention, the second connector support is arranged to support the flexible connector so that the flexible connector extends along the swivel bracket in a front-rear direction. According to this arrangement, the flexible connector is guided forwardly along the swivel bracket, and is supported at a support position fixed by the first connector support. As a result, a large load is never imposed on the flexible connector because of the turning (tilting) in the up-down direction of the swivel bracket. Therefore, it is possible to reduce a load imposed on the flexible connector while reliably supporting the flexible connector by the first and second connector supports and supporting the flexible connector at a support position fixed by the first connector support.

In a preferred embodiment of the present invention, the outboard motor mounting structure further includes a first cover that covers the first connector support and the flexible connector in front of the engine cover. According to this arrangement, it is possible to protect the first connector support and a supported portion of the flexible connector that is supported thereby with the cover. Besides, it is possible to improve the exterior because the flexible connector is covered with the cover, and hence is not exposed to the outside.

In a preferred embodiment of the present invention, the first connector support includes a stay fixed to the first cover. According to this arrangement, there is no need to prepare a structure to individually mount the cover and the first connector support on the hull, and therefore it is possible to simplify the structure of the hull, and, accordingly, it becomes easy to design and produce the hull.

In a preferred embodiment of the present invention, the first cover is disposed so that a relative position with respect to the mounting bracket does not change depending on a tilt angle of the outboard motor body. According to this arrangement, the first cover never moves in accordance with the tilt of the outboard motor body, and therefore there is no need to provide the inside of the hull with a large space to allow the first cover to move. Therefore, it is possible to simplify the structure of the hull, and, accordingly, it becomes easy to design and produce the hull.

In a preferred embodiment of the present invention, the engine cover includes a lower surface including an opening through which the flexible connector is inserted inwardly. According to this arrangement, it is possible to insert the flexible connector into the inside of the engine cover from the lower surface of the engine cover, and therefore it is possible to make the length of the flexible connector from the region adjacent to the mounting bracket to the engine cover shorter than in a structure in which the flexible connector is inserted from the side surface of the engine cover. Additionally, the flexible connector does not protrude from the side surface of the engine cover, and therefore the movement of the flexible connector responding to the turning of the outboard motor body in the up-down direction or in the left-right direction is inconspicuous, and it is also possible to allow the movable range of the flexible connector to be within the movable range of the outboard motor body. This makes it possible to exclude a space required for the movement of the flexible connector responding to the movement of the outboard motor body, and makes it possible to improve the exterior.

In a preferred embodiment of the present invention, the outboard motor mounting structure further includes a second cover with which the flexible connector is covered in front of the opening. According to this arrangement, it is possible to reliably protect the flexible connector, and it is possible to render the flexible connector more inconspicuous, and hence is possible to improve the exterior.

In a preferred embodiment of the present invention, the engine cover includes a downwardly extending wall that protrudes downwardly in front of the opening and that prevents the opening from being exposed. According to this arrangement, the opening and the flexible connector become even more inconspicuous, and therefore it is possible to improve the exterior, and it is possible to protect the flexible connector and the internal structure of the engine cover.

An outboard motor mounting structure according to a preferred embodiment of the present invention includes a mounting bracket that is fixed to the hull, a swivel bracket that is joined to the mounting bracket so as to be tiltable around a tilt axis and that supports the outboard motor body, a flexible connector that includes at least one of a wire, an operating cable, and a pipe that connects a piece of equipment on the hull and a piece of equipment provided in the outboard motor body, and a first cover that is disposed so as to extend forwardly from the engine cover and so as to cover the flexible connector. The relative position of the first cover with respect to the mounting bracket does not change depending on a tilt angle of the outboard motor body.

According to this arrangement, the mounting bracket is fixed to the hull. The swivel bracket is joined to the mounting bracket so as to be tiltable. Therefore, the outboard motor body is tiltable with respect to the hull together with the swivel bracket.

On the other hand, a piece of equipment on the hull and apiece of equipment provided in the outboard motor body are connected together by a flexible connector including at least one of a wire, an operating cable, and a pipe. This connector is covered and protected with the first cover in front of the engine cover. The first cover does not change its relative position with respect to the mounting bracket depending on a tilt angle of the outboard motor body. Therefore, even when the outboard motor body is tilted, substantial displacement of the first cover that results from its operation never occurs.

Therefore, even if the flexible connector moves because of the tilt of the outboard motor body, its moving range is limited by the first cover, and therefore it becomes unnecessary to provide the hull with a large space (motor well) considering the displacement of the flexible connector caused by the operation of the outboard motor body. This makes it possible to increase the strength of a hull structure, and makes it possible to facilitate the design and production of the hull. Additionally, it becomes possible to widen an inboard residence space and to reduce the hull in size. Moreover, the movement of the flexible connector in response to the operation of the outboard motor body is not seen, and therefore it is possible to provide an outboard motor mounting structure that has good visual quality.

In a preferred embodiment of the present invention, the first cover includes openings through which the flexible connector passes at a lower portion of the first cover and at a rear portion of the first cover, respectively. According to this arrangement, it is possible to insert the flexible connector into the first cover from the hull through the opening of the lower portion of the first cover. Additionally, it is possible to pull the flexible connector toward the outboard motor body through the opening of the rear portion of the first cover.

In a preferred embodiment of the present invention, the engine cover includes a lower surface including an opening through which the flexible connector is inserted inwardly. According to this arrangement, it is possible to insert the flexible connector into the inside of the engine cover from the lower surface of the engine cover, and therefore it is possible to make the length of the flexible connector from the region adjacent to the mounting bracket to the engine cover shorter than in a structure in which the flexible connector is inserted from the side surface of the engine cover. Additionally, the flexible connector does not protrude from the side surface of the engine cover, and therefore the movement of the flexible connector in response to the turning of the outboard motor body in the up-down direction or in the left-right direction is inconspicuous, and it is also possible to allow the movable range of the flexible connector to be within the movable range of the outboard motor body. This makes it possible to exclude a space required for the movement of the flexible connector in response to the movement of the outboard motor body, and makes it possible to improve the exterior.

In a preferred embodiment of the present invention, the outboard motor mounting structure further includes a second cover with which the flexible connector is covered in front of the opening. According to this arrangement, it is possible to reliably protect the flexible connector, and it is possible to render the flexible connector more inconspicuous, and hence it is possible to improve the exterior.

In a preferred embodiment of the present invention, the engine cover includes a downwardly extending wall that protrudes downwardly in front of the opening and that prevents the opening from being exposed. According to this arrangement, the opening and the flexible connector become even more inconspicuous, and therefore it is possible to improve the exterior, and it is possible to protect the flexible connector and the internal structure of the engine cover.

Another preferred embodiment of the present invention includes an outboard motor vessel including a hull, an outboard motor body, and an outboard motor mounting structure that includes the features described above. According to this arrangement, it is possible to simplify the structure of the hull, and it is possible to provide an outboard motor vessel whose exterior is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
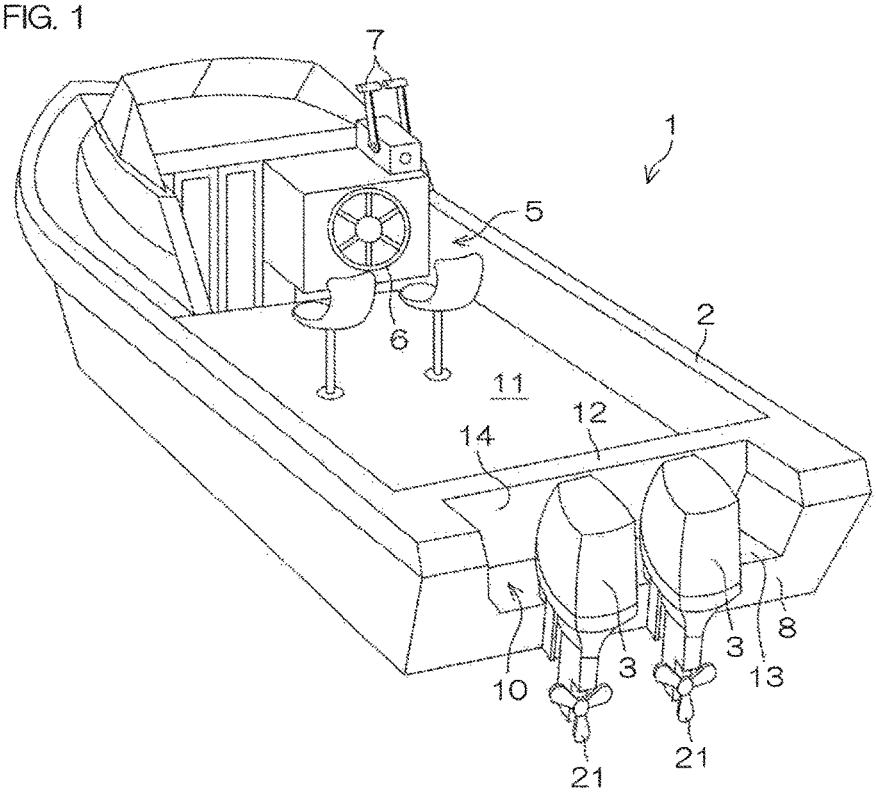
FIG. 1 is a perspective view of an outboard motor vessel according to a preferred embodiment of the present invention.

FIG. 1 is a perspective view of an outboard motor vessel according to a preferred embodiment of the present invention. The outboard motor vessel 1 includes a hull 2 and an outboard motor 3 mounted on the hull 2. In the present preferred embodiment, two outboard motors 3 preferably are arranged on the right and left sides, respectively, and are attached to the stern of the hull 2.

The hull 2 includes a navigator seat 5 near an intermediate position with respect to a front-rear direction. Operating devices, such as a steering wheel 6 and a shift/throttle lever 7, are disposed at the navigator seat 5. Outboard motors 3 (in the present preferred embodiment, a pair of outboard motors 3) are attached to a stern plate 8 of the hull 2. A motor well 10 is provided in the hull 2 in front of the outboard motors 3. A partition wall 12 that partitions a residence space 11 for the crew is disposed in front of the motor well 10. The motor well 10 is a concave portion having a necessary and sufficient size to accept the forward portion of an engine cover 28 of the outboard motor 3 and hence to secure a necessary maximum tilt angle when the outboard motor 3 is tilted up.

Figure 2:
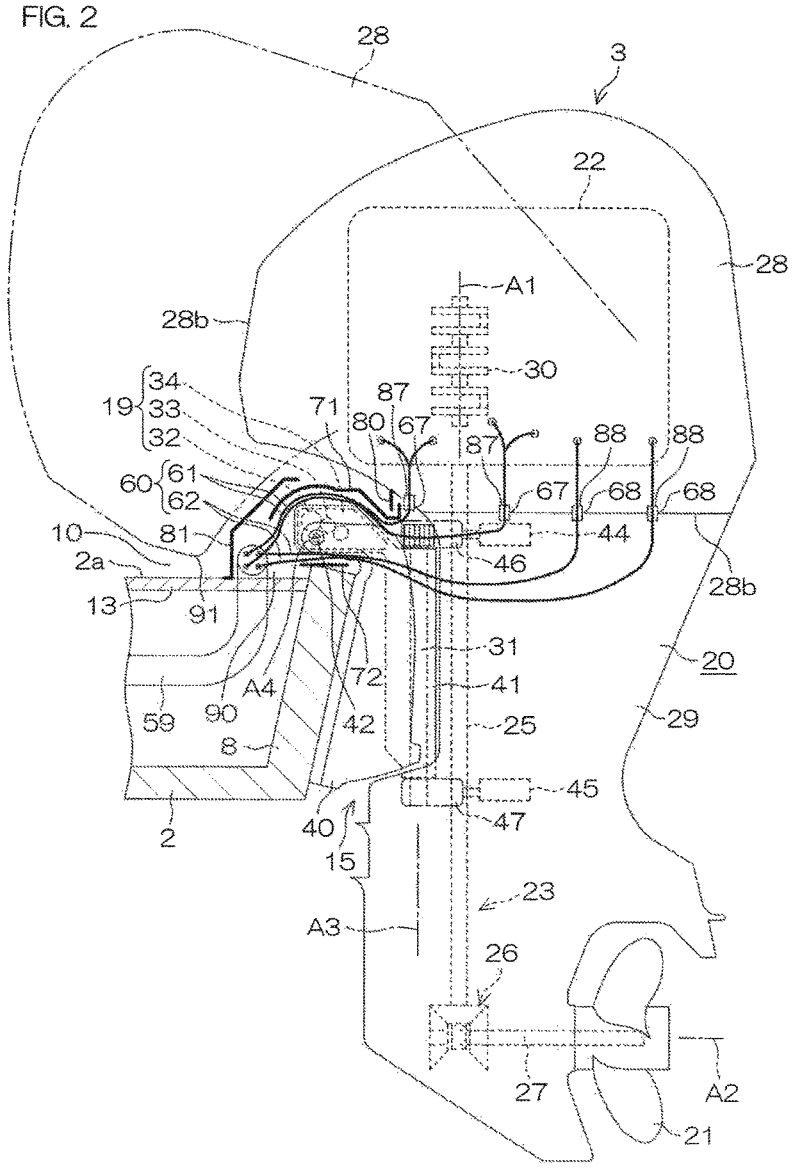
FIG. 2 is a side view showing an outboard motor body and a mounting structure that mounts the outboard motor body.

FIG. 2 is a side view showing the outboard motor body and a mounting structure to mount the outboard motor body. The outboard motor 3 is depicted in FIG. 2 in a basic posture in which a crankshaft axis A1 extends in the vertical direction and in which a propeller axis A2 perpendicular to the crankshaft axis A1 extends in the front-rear direction of the outboard motor vessel 1. Let it be supposed that the up-down direction, the left-right direction, and the front-rear direction are defined based on the basic posture in the following description, except when a specifically detailed mention is made.

A suspension device 15 is attached to the rear portion (stern) of the hull 2. The outboard motor body 20 is connected to the suspension device 15. An electrically-operated steering device 19 is attached to the suspension device 15. The electrically-operated steering device 19 is arranged to steer the outboard motor body 20 in the left-right direction with respect to the suspension device 15, i.e., with respect to the hull 2.

The outboard motor body 20 includes a propeller 21, an engine 22 that generates power to rotate the propeller 21, and a power transmission 23 that transmits the power of the engine 22 to the propeller. The power transmission 23 includes a drive shaft 25 connected to the engine 22, a forward/backward switching mechanism 26 connected to the drive shaft 25, and a propeller shaft 27 connected to the forward/backward switching mechanism 26. The outboard motor body 20 additionally includes an engine cover 28 that contains the engine 22 and a case 29 that contains the power transmission 23.

The engine 22 is disposed above the drive shaft 25. An upper end of the drive shaft 25 is joined to the crankshaft 30 of the engine 22. A lower end of the drive shaft 25 is joined to the forward/backward switching mechanism 26. The propeller shaft 27 extends in the front-rear direction in the case 29, and its front end is connected to the forward/backward switching mechanism 26. A rear end of the propeller shaft 27 protrudes rearwardly from the case 29. The propeller 21 is attached to the rear end of the propeller shaft 27. Therefore, the propeller 21 is rotatable around the propeller axis A2 (i.e., a center line of the propeller shaft 27) together with the propeller shaft 27.

The engine 22 is, for example, an internal combustion engine. The engine 22 rotates in a predetermined rotational direction. The rotation of the engine 22 is transmitted to the propeller 21 by the power transmission 23. The forward/backward switching mechanism 26 switches the direction of rotation transmitted from the drive shaft 25 to the propeller shaft 27 between a normal rotation direction and a reverse rotation direction. When the propeller shaft 27 rotates in the normal rotation direction, the propeller 21 rotating in the normal rotation direction generates a forward thrust that moves the hull 2 forwardly. When the propeller shaft 27 rotates in the reverse rotation direction, the propeller 21 rotating in the reverse rotation direction generates a backward thrust that moves the hull 2 backwardly.

The electrically-operated steering device 19 includes a steering motor 32 that generates power to turn the steering shaft 31 around a steering axis A3, a steering-force transmission 33 that transmits power (steering force) from the steering motor 32 to the steering shaft 31, and a steering housing 34 that contains these components although these components are not depicted in detail in the drawings. The steering housing 34 is fixed to a swivel bracket 41. The swivel bracket 41 is disposed between a pair of clamp brackets 40, and is supported by the clamp brackets 40. One example of the electrically-operated steering device 19 mentioned above is disclosed by US 2015/0093947 A1, and the entire contents of this document are incorporated herein by reference.

Figure 3A:
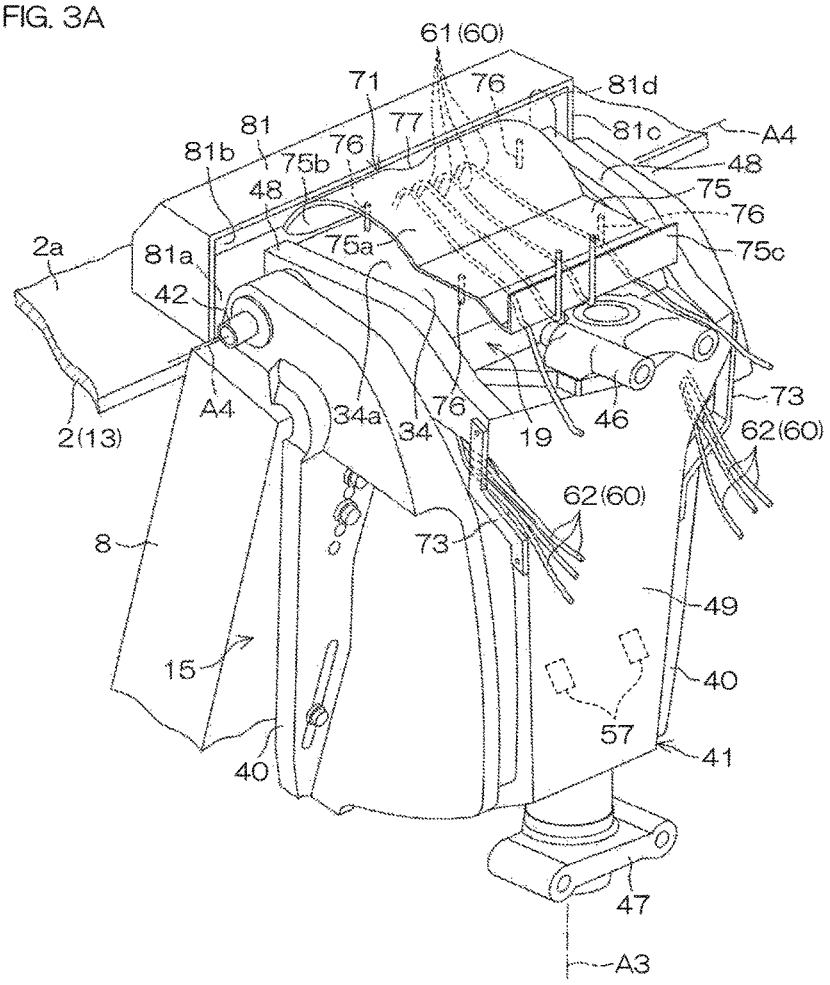
FIG. 3A is a perspective view showing an arrangement near a swivel bracket in a basic-posture state.
Figure 3B:
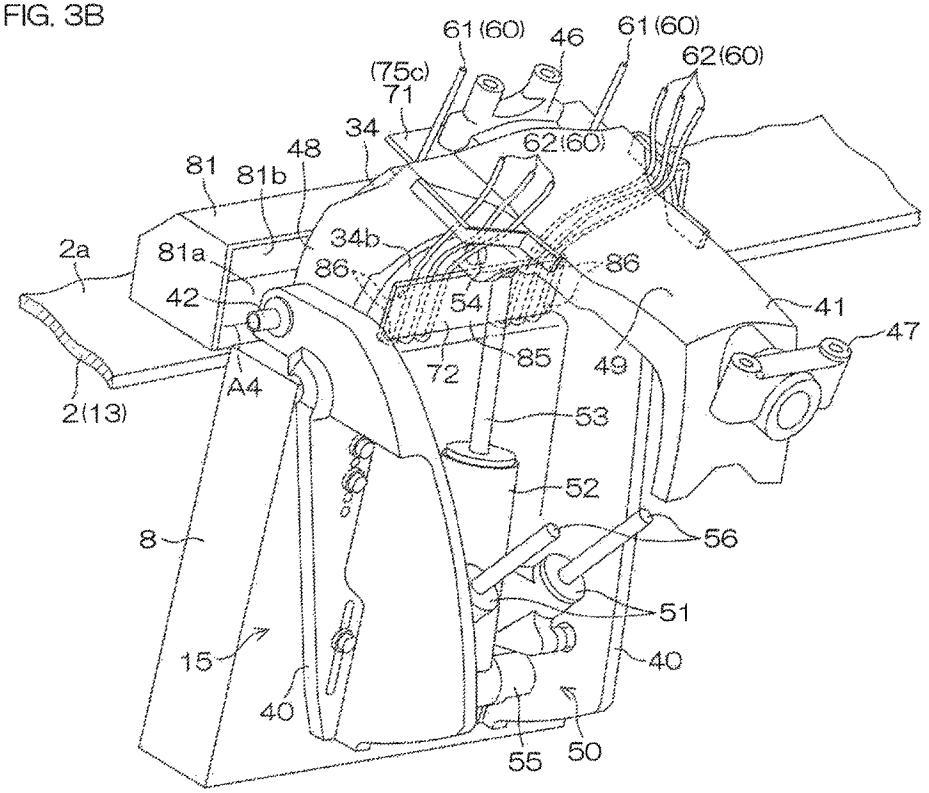
FIG. 3B is a perspective view showing a state in which the swivel bracket has been tilted up.
Figure 4:
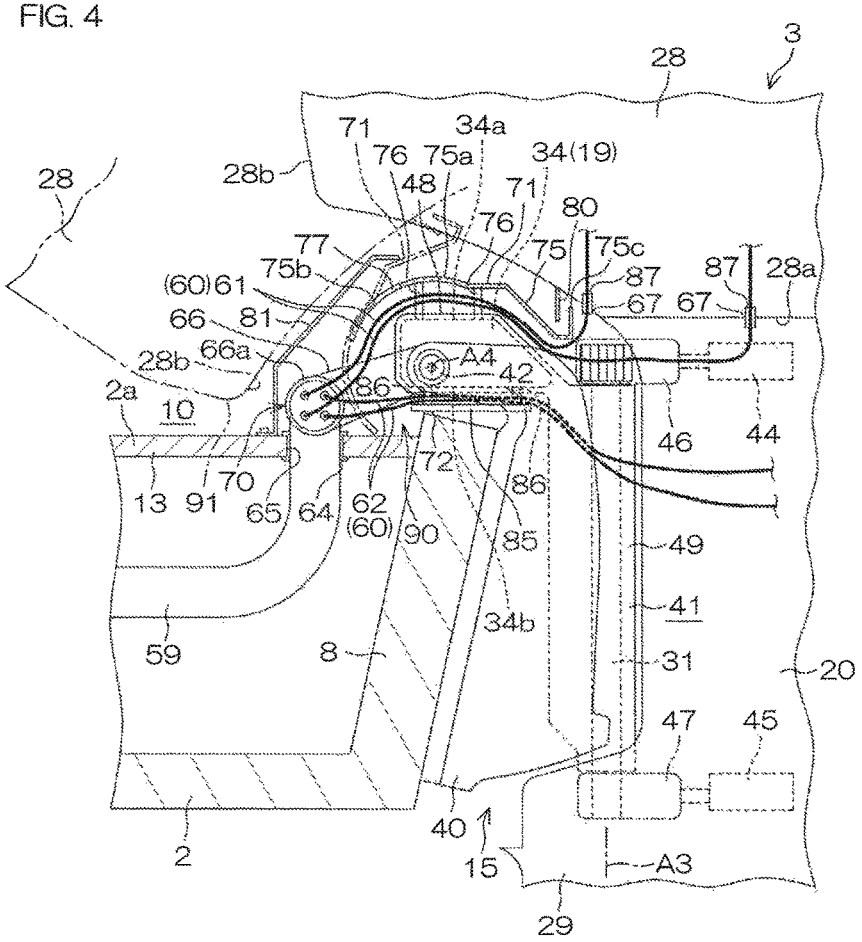
FIG. 4 is an enlarged, cross-sectional view of an arrangement near a suspension device.

FIG. 3A and FIG. 3B are perspective views showing an arrangement near the swivel bracket 41. FIG. 3A shows a basic posture state, and FIG. 3B shows a tilted-up state in which the swivel bracket 41 has been tilted up. Additionally, FIG. 4 is an enlarged, cross-sectional view that shows an arrangement near the suspension device 15.

The tilted-up state is a state in which the lower end of the swivel bracket 41 has been lifted high by turning the swivel bracket 41 upwardly around the tilt axis A4 with respect to the basic posture. The outboard motor body 20 is turned in the up-down direction together with the swivel bracket 41. Therefore, under the tilted-up state, a state is reached in which the propeller 21 has been lifted high. The positions of the engine cover 28 etc., when the outboard motor body 20 is tilted up to the maximum tilt angle are shown in FIG. 2 and FIG. 4 with the alternate long and two short dashes line.

The suspension device 15 includes the right-and-left pair of clamp brackets 40 that are attached to the hull 2 and a tilt shaft 42 supported by the pair of clamp brackets 40 in a posture extending in the left-right direction. The tilt shaft 42 may be divided into a right-and-left pair of shanks supported by the pair of clamp brackets 40, respectively. The suspension device 15 additionally includes the swivel bracket 41 attached to the tilt shaft 42 and the steering shaft 31 (see FIG. 2 and FIG. 4) supported by the swivel bracket 41 in a posture extending in the up-down direction. The clamp bracket 40 is one example of a mounting bracket that is fixed to the hull 2.

The outboard motor body 20 is connected to the upper end of the steering shaft 31 through an upper mount 44. The outboard motor body 20 is further connected to the lower end of the steering shaft 31 through a lower mount 45. In more detail, an upper-mount support 46 is fixed to the upper end of the steering shaft 31, and the upper mount 44 is joined to the upper-mount support 46 by a bolt, for example. Likewise, a lower-mount support 47 is fixed to the lower end of the steering shaft 31, and the lower mount 45 is joined to the lower-mount support 47 by a bolt, for example.

The steering shaft 31 is supported by the swivel bracket 41 rotatably around the steering axis A3 extending in the up-down direction. Therefore, the outboard motor body 20 is turnable (steerable) together with the steering shaft 31 in the left-right direction with respect to the swivel bracket 41. The swivel bracket 41 is supported by the clamp bracket 40 with the tilt shaft 42 therebetween. The swivel bracket 41 is turnable around the tilt axis A4 extending in the left-right direction with respect to the clamp bracket 40. Therefore, the outboard motor body 20 is turnable (tiltable) in the up-down direction around the tilt axis A4 together with the swivel bracket 41. The swivel bracket 41 includes a tilt-shaft holder portion 48 that holds the tilt shaft 42 and a steering-shaft holder 49 that holds the steering shaft 31 rotatably around the steering axis A3.

The suspension device 15 additionally includes a power trim/tilt mechanism 50 (hereinafter, referred to as a "PTT") that generates power to pivot the outboard motor body 20 in the up-down direction around the tilt axis A4 together with the swivel bracket 41. The PTT 50 is disposed between the pair of clamp brackets 40. The PTT 50 is connected to the clamp brackets 40 and to the swivel bracket 41, and is arranged to pivot the swivel bracket 41 in the up-down direction around the tilt axis A4 with respect to the clamp brackets 40.

The PTT 50 includes a plurality of cylinders 51 and 52 to turn the outboard motor body 20 in the up-down direction. In the present preferred embodiment, the plurality of cylinders include two trim cylinders 51 and one tilt cylinder 52. In the present preferred embodiment, any of these cylinders 51 and 52 may be an oil hydraulic cylinder. The tilt cylinder 52 includes a basal end supported by a frame 55 spanning a gap between the clamp brackets 40. The two trim cylinders 51 are disposed with a space therebetween in the left-right direction, and are joined to the right and left clamp brackets 40, respectively. The tilt cylinder 52 is disposed between the two trim cylinders 51.

The basal end of the tilt cylinder 52 is turnably joined to the frame 55. A rod 53 (tilt rod) of the tilt cylinder 52 is connected to the swivel bracket 41 through a pin 54. Therefore, it is possible to tilt the outboard motor body 20 up and down by advancing and retreating the tilt rod 53 while operating the tilt cylinder 52. In a state in which the outboard motor body 20 has been tilted down, the propeller 21 is positioned in the water, and it is possible to generate a thrust by power generated by the outboard motor body 20. In a state in which the outboard motor body 20 has been tilted up to the maximum tilt angle, the propeller 21 is positioned above the water surface.

The trim cylinder 51 is fixedly joined to the clamp brackets 40. A rod 56 (trim rod) of the trim cylinder 51 is disposed so as to come into contact with a receiving portion 57 disposed on a front surface (i.e., surface closer to the hull 2) of the swivel bracket 41. Therefore, it is possible to change the angle of the swivel bracket 41 with respect to the clamp brackets 40 by advancing and retreating the trim rod 56, and it is possible to change the angle (trim angle) of the propeller shaft 27 with respect to the hull 2. When the propeller 21 is in the water, adjustment of the trim angle makes it possible to adjust a hull posture during movement.

Both the tilt angle and the trim angle are turning-angles of the swivel bracket 41 or of the outboard motor body 20 around the tilt axis A4, and therefore, for convenience, the tilt angle and the trim angle are referred to generically as a "tilt angle" in this description.

Figure 5:
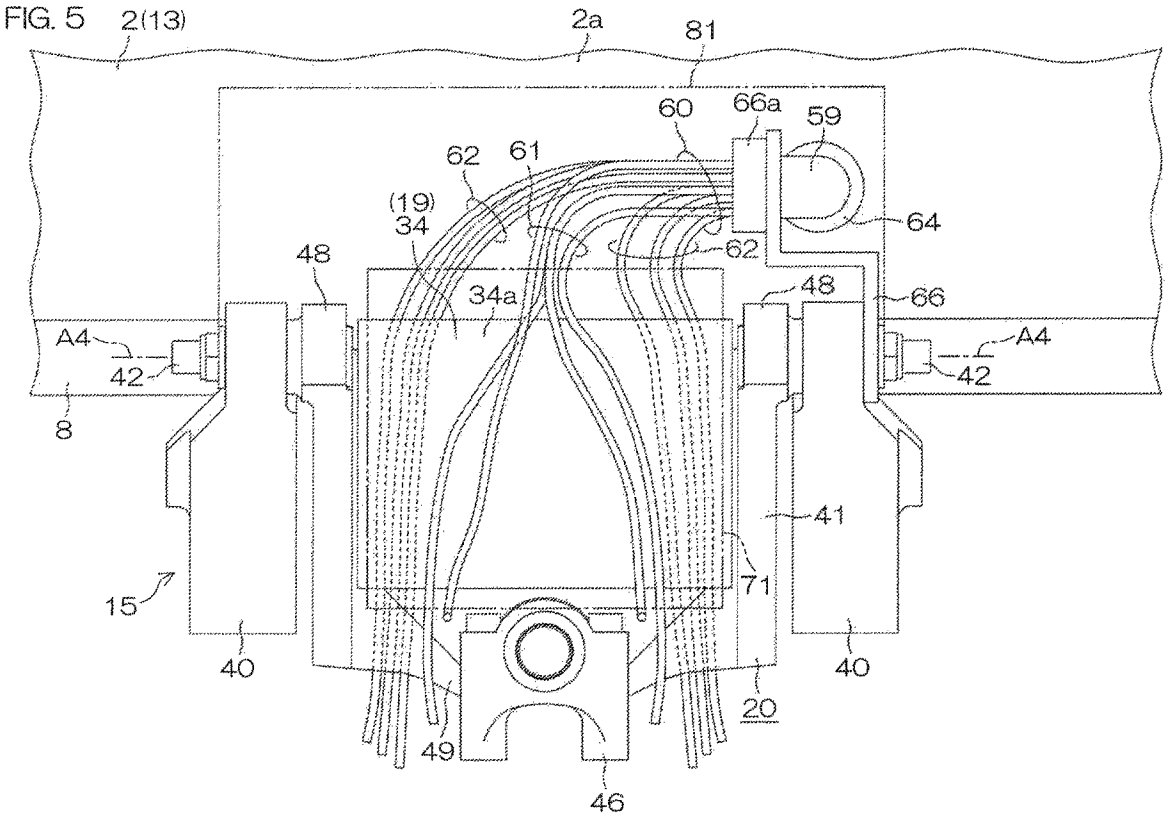
FIG. 5 is a plan view showing the disposition of cables between a hull and the outboard motor body.
Figure 6:
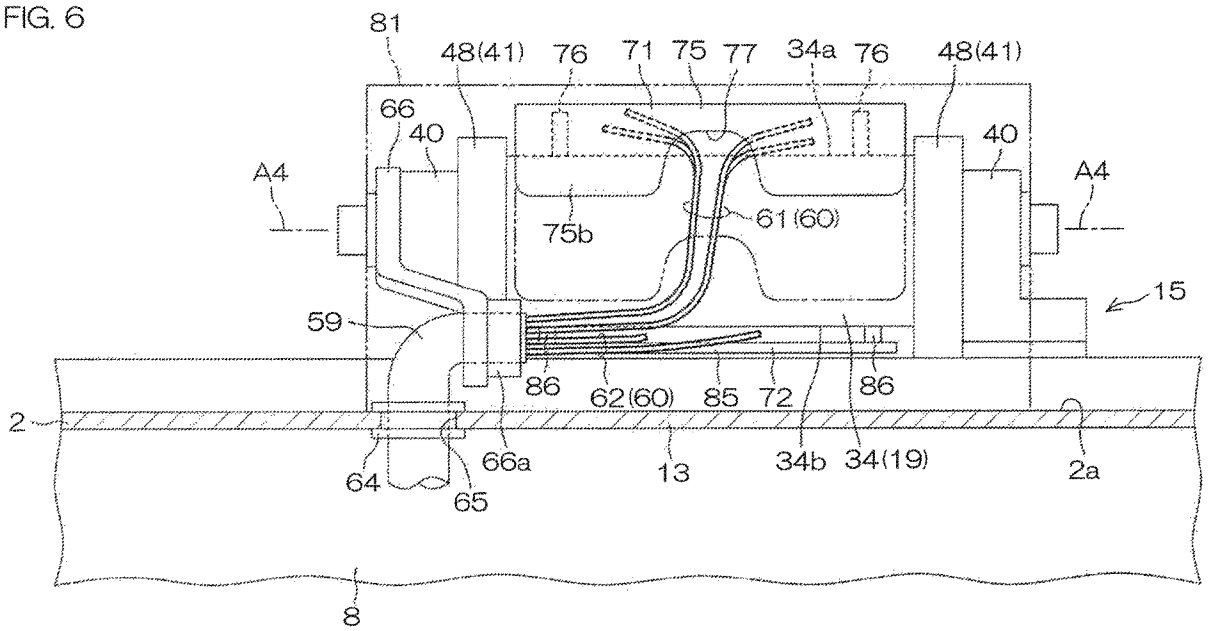
FIG. 6 is a front view of the suspension device viewed rearwardly from the hull.

FIG. 5 is a plan view showing the disposition of cables 60 between the hull 2 and the outboard motor body 20. FIG. 6 is a front view of the suspension device 15 viewed rearwardly from the hull 2.

Herein, the term "cables 60" is used as a term that generically designates flexible connectors that connect the hull 2 and the outboard motor body 20 together. In more detail, the cables 60 include operating cables, electric cables, and pipes.

The operating cables include cables that transmit an operating force applied by a vessel navigator to an operating member disposed at the navigator seat. In more detail, a steering wire cable that transmits an operating force applied to the steering wheel 6, a shift/throttle wire cable that transmits an operating force applied to the shift/throttle lever 7, etc. The steering wire cable is excluded if a steer-by-wire system is used in which the operation of the steering wheel 6 is detected by a sensor and in which its detection result is transmitted to the engine control unit (ECU) of the outboard motor 3. In the present preferred embodiment, the electrically-operated steering device 19 is provided, and the steer-by-wire system is used, and therefore the steering wire cable is not provided. If a drive-by-wire system is used in which the operation applied to the shift/throttle lever 7 is detected by a sensor and in which its detection result is transmitted to the engine control unit of the outboard motor, the shift/throttle wire cable is excluded.

The electric cables include, for example, an electric power wire that connects a battery disposed on the hull 2 and the outboard motor body 20 together and a signal wire that connects a controller and the sensors disposed on the hull 2 and the engine control unit of the outboard motor body 20 together. The electric power wire supplies electric power generated by the battery to the outboard motor body 20 or supplies and charges the battery with electric power generated by a power generator provided in the outboard motor body 20. The signal wire transmits signals, such as a control signal and a sensor signal. The pipes include a fuel hose that supplies fuel from a fuel tank provided on the hull 2 to the outboard motor body 20. The battery disposed on the hull 2, the controller, the sensors, etc., are examples of pieces of equipment provided on the hull 2.

The cables 60 are contained in the rigging hose 59 in a state in which some or all of the cables 60 are gathered together. The rigging hose 59 is, for example, an accordion-folded flexible hose, and is inserted into the inside of the hull 2 through a through-hole 65 in a ceiling wall 13 that defines the upper surface 2*a* of the hull 2 in the motor well 10. In other words, the rigging hose 59 extends from the upper surface 2*a* of the hull 2. A waterproof component 64, such as a rubber bushing, that prevents the inside of the hull 2 from being flooded with water is disposed around the through-hole 65. Additionally, the forward end of the rigging hose 59 extending from the hull 2 is subjected to waterproof processing to prevent the inside of the rigging hose 59 from being flooded with water. The cables 60 extend from the forward end of the rigging hose 59, and the cables 60 extend to the outboard motor body 20.

The forward end of the rigging hose 59 is supported by a stay 66 (see FIG. 4 to FIG. 6) joined to the clamp bracket 40. Therefore, one end of the rigging hose 59 is supported at a support position 70 whose relative position with respect to the clamp bracket 40 does not change. In more detail, the support position 70 of one end of the rigging hose 59 does not depend on the turning angle of the swivel bracket 41 around the tilt axis A4 (i.e., the tilt angle of the outboard motor body 20), and does not change. Additionally, the support position 70 of one end of the rigging hose 59 does not depend on the turning angle (i.e., steering angle) of the outboard motor body 20 around the steering axis A3, and does not change. The stay 66 is one example of a first connector support.

First cables 61 from among the cables 60 that extend from the forward end of the rigging hose 59 pass between the pair of clamp brackets 40 in a plan view, and extend along the upper surface 34*a* of the steering housing 34 in the front-rear direction in a lateral view. Some of the first cables 61 are further guided upwardly near the steering shaft 31, and extend into the engine cover 28 through an opening 67 in a lower surface 28*a* of the engine cover 28. Other cables (i.e., other ones of) of the first cables 61 are guided into the case 29, and extend into the engine cover 28 from the case 29 through an opening 67 in a lower surface 28*a* of the engine cover 28. Herein, the term "the lower surface 28*a* of the engine cover 28" denotes a surface directed downwardly when the outboard motor body 20 is in a basic posture. The opening 67 is provided in the lower surface 28*a*, and opens downwardly. A waterproof component 87, such as a rubber bushing, is disposed in the opening 67, and the first cables 61 are inserted upwardly into the engine cover 28 through the waterproof component 87.

The second cables 62, which are other ones of the cables 60, that extend from the forward end of the rigging hose 59 pass between the pair of clamp brackets 40 in a plan view, and extend in the front-rear direction through the lower side of the steering housing 34 in a lateral view. The second cables 62 are further guided to a space behind the swivel bracket 41 through the lateral side of the swivel bracket 41 or through a through-hole in the swivel bracket 41. The second cables 62 are further inserted into the case 29 of the outboard motor body 20, and are guided upwardly in the case 29. Furthermore, the second cables 62 extend into the engine cover 28 through an opening 68 in the lower surface 28*a* of the engine cover 28. The opening 68 is provided in the lower surface 28*a*, and opens downwardly. A waterproof component 88, such as a rubber bushing, is disposed in the opening 68, and the second cables 62 are inserted upwardly into the engine cover 28 through the waterproof component 88.

Preferably, the cables 60 are classified into the first cables 61 and the second cables 62 in accordance with their connection position in the engine cover 28. In more detail, preferably, cables whose connection positions in the engine cover 28 are located comparatively forwardly are classified as the first cables 61. Additionally, preferably, cables whose connection positions in the engine cover 28 are located comparatively rearwardly are classified as the second cables 62. As a result, it is possible to locate the cables at positions near where they enter the engine cover 28 and is possible to insert each cable into the engine cover 28 from below, and therefore it is possible to minimize the layout area of the cables 60 in a narrow space in the engine cover 28.

A first cable guide 71 is attached to the upper surface 34*a* of the steering housing 34. In other words, the first cable guide 71 is fixed to the swivel bracket 41 with the steering housing 34 therebetween. The first cable guide 71 includes a plate-shaped portion 75 disposed above the upper surface 34*a* of the steering housing 34 with a space therebetween and a support pillar 76 that fixes the plate-shaped portion 75 to the upper surface 34*a* of the housing. The first cables 61 pass through a space between the plate-shaped portion 75 and the upper surface 34*a* of the housing in the front-rear direction. Therefore, the first cable guide 71 supports the first cable 61 along the swivel bracket 41. When the swivel bracket 41 turns around the tilt axis A4, some of the first cables 61 guided by the first cable guide 71 turn in accordance with its turning. Therefore, near the opening 67 of the lower surface 28*a* of the engine cover 28, the first cables 61 do not change their relative position with respect to the engine cover 28 depending on the turning position of the swivel bracket 41, i.e., depending on the tilt angle of the outboard motor body 20.

The plate-shaped portion 75 of the first cable guide 71 includes an upper-surface cover 75*a* that extends along the upper surface 34*a* of the steering housing 34. The plate-shaped portion 75 of the first cable guide 71 additionally includes a front-surface cover 75*b* that curves and extends downward so as to cover the front surface of the steering housing 34 in the front edge of the upper-surface cover 75*a*. In more detail, the front-surface cover 75*b* curves so as to define a circular arc that is centered on the tilt axis A4 in a lateral view. The plate-shaped portion 75 additionally includes a rising portion 75*c* that rises upwardly from the rear edge of the upper-surface cover 75*a* toward the engine cover 28. The engine cover 28 includes a downwardly extending wall 80 that extends downwardly in front of the opening 67 of the lower surface 28*a* and in front of the rising portion 75*c*. The downwardly extending wall 80 overlaps with the rising portion 75*c* when viewed from the front. The first cables 61 extend upwardly behind the rising portion 75*c* and into the engine cover 28 from the opening 67, and are disposed so that they are not viewed from the outside. In the front-surface cover 75*b*, a cut-out 77 is provided in its intermediate portion in the left-right direction, and the first cables 61 are inserted through the cut-out 77. When the outboard motor body 20 is tilted up, the first cable guide 71 turns together with the swivel bracket 41, and then the first cables 61 enter the inside of the cut-out 77. The rising portion 75*c* is one example of a second cover in a preferred embodiment of the present invention.

A cover 81 is disposed in front of the first cable guide 71. The cover 81 covers a portion of the rigging hose 59 extending from the upper surface 2*a* of the hull 2 from above and covers the front-surface cover 75*b* of the first cable guide 71 from above. The cover 81 includes openings 81*a* and 81*b* through which the cables 60 pass at a lower portion and a rear portion of the cover 81, respectively (see FIG. 3A and FIG. 3B). The rigging hose 59 and the cables 60 are covered with the cover 81, and cannot be visually perceived from the outside in an ordinary state. In the present preferred embodiment, the cover 81 is fixed to the ceiling wall 13 of the motor well 10 by, for example, a bolt. Therefore, the cover 81 does not change its relative position with respect to the clamp bracket 40 depending on the turning of both the swivel bracket 41 and the outboard motor body 20 around the tilt axis A4, or depending on the turning of the outboard motor body 20 around the steering axis A3. The cover 81 is one example of a first cover in a preferred embodiment of the present invention.

A second cable guide 72 is attached to the lower surface 34*b* of the steering housing 34. In other words, the second cable guide 72 is fixed to the swivel bracket 41 with the steering housing 34 therebetween. The second cable guide 72 includes a plate-shaped portion 85 disposed below the lower surface 34*b* of the steering housing 34 with a space therebetween and a support pillar 86 that fixes the plate-shaped portion 85 to the lower surface 34*b* of the steering housing 34. The second cables 62 pass through a space between the plate-shaped portion 85 and the lower surface 34*b* of the housing in the front-rear direction. Therefore, the second cable guide 72 supports the second cables 62 along the swivel bracket 41. When the swivel bracket 41 turns around the tilt axis A4, some of the second cables 62 guided by the second cable guide 72 turn in accordance with the swivel bracket 41. Therefore, the position of the second cables 62 in the opening 68 of the lower surface 28*a* of the engine cover 28 does not change depending on the turning of the swivel bracket 41.

A pair of third cable guides 73 that hold the second cables 62 are fixed to the right and left side surfaces of the steering-shaft holder 49 of the swivel bracket 41, respectively. The pair of third cable guides 73 guide the second cables 62 guided from the front side into the rear case 29 disposed on the rear side. In the present preferred embodiment, the second cables 62 are divided into right cables and left cables, and these two divided cables are held by the right-and-left pair of third cable guides 73, respectively, and are guided rearwardly through the lateral sides of the steering-shaft holder 49, respectively. The second cables 62 in the case 29 are held therein by the inner surface of the case 29. Therefore, the second cables 62 turn in response to the tilt operation of the outboard motor body 20. Therefore, the position of the second cables 62 in the opening 68 of the lower surface 28*a* of the engine cover 28 does not change depending on the tilt angle of the outboard motor body 20.

The first, second, and third cable guides 71, 72, and 73 are examples of a second connector support in a preferred embodiment of the present invention.

As is best shown in FIG. 4, the support position 70 that does not change its relative position with respect to the clamp bracket 40 is located in a region 90 adjacent to the clamp bracket 40. The adjacent region 90 is most easily seen in a lateral view. The boundary on the front side of the adjacent region 90 is a lowest point 91 of the engine cover 28 in a tilted-up state in which the maximum tilt angle has been reached, whereas the boundary on the rear side of the adjacent region 90 is the tilt axis A4 (in more detail, the inner surface of the stern plate 8). Additionally, the boundary on the upper side of the adjacent region 90 is fixed by the surface 28*b* of the engine cover 28 in a tilted-up state in which the maximum tilt angle has been reached, whereas the boundary on the lower side thereof is fixed by the upper surface 2*a* of the hull 2.

In the present preferred embodiment, the support position 70 is in front of the clamp bracket 40, is behind the lowest point 91 of the engine cover in a tilted-up state, is above the upper surface 2*a* of the hull 2, and is below the surface 28*b* of the engine cover in a tilted-up state.

Although the adjacent region 90 is not subject to particular limitations concerning the left-right direction, the adjacent region 90 preferably extends in the right-left width of the hull 2, and, in more detail, preferably within the right-left width of the motor well 10. More specifically, the adjacent region 90 is within a width of about, for example, twice the distance between the pair of clamp brackets 40 (more preferably, about 1.5 times, for example) and centered on the crankshaft axis A1. Even more specifically, the adjacent region 90 is a region in which the cover 81 that covers the adjacent region 90 has a horizontal width (width in the left-right direction) equal or approximately equal to or narrower than the entire horizontal width of the right-and-left pair of clamp brackets 40. This makes it possible to achieve a compact arrangement, and makes it possible to achieve a good-looking exterior that arouses a sense of unity between the clamp bracket 40 and the cover 81.

Figure 7A:
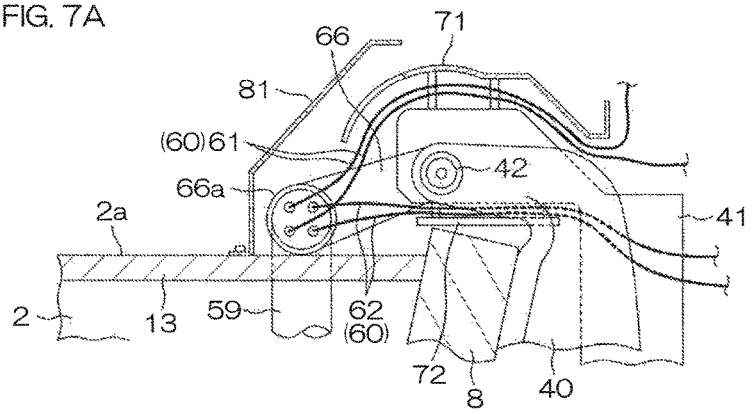
FIG. 7A is a cross-sectional view showing a first fixed example of a rigging hose.

FIG. 7A is a cross-sectional view showing a first fixed-structure of the rigging hose 59. The stay 66 is fixed to the clamp bracket 40. The stay 66 includes a cylindrical portion 66*a*. The forward end of the rigging hose 59 is inserted into and is fixed to the cylindrical portion 66*a*. In this example, the cylindrical portion 66*a* is oriented with its axis extending in the left-right direction so as to insert the rigging hose 59 in the left-right direction. As is best shown in FIG. 6, the rigging hose 59 extends upwardly from the ceiling wall 13 of the motor well 10 on the outer side with respect to the left-right direction than one of the pair of clamp brackets 40, and is then bent inwardly, and extends to the cylindrical portion 66*a* of the stay 66.

Figure 7B:
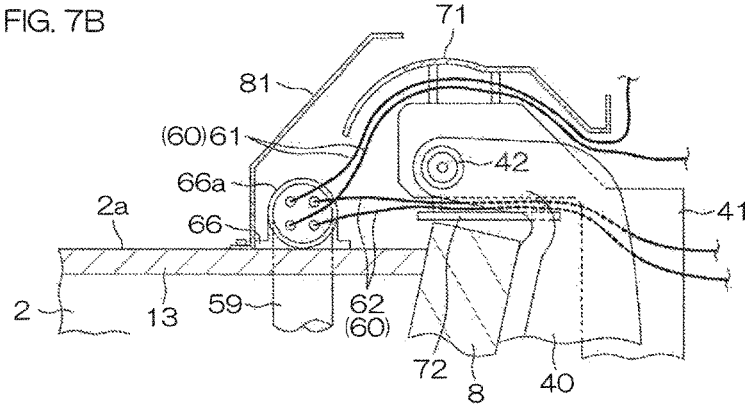
FIG. 7B is a cross-sectional view showing a second fixed example of the rigging hose.

FIG. 7B is a cross-sectional view showing a second fixed-structure of the rigging hose 59. In this example, the stay 66 is fixed to the upper surface 2*a* of the hull 2 (i.e., the upper surface of the ceiling wall 13). Except for this, the second fixed-structure is preferably the same as the first fixed-structure (see FIG. 7A).

Figure 7C:
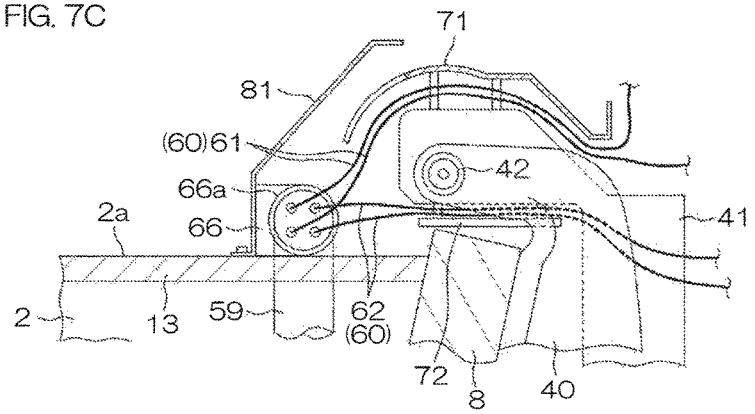
FIG. 7C is a cross-sectional view showing a third fixed example of the rigging hose.

FIG. 7C is a cross-sectional view showing a third fixed-structure of the rigging hose 59. In this example, the stay 66 is fixed to the inner surface of the cover 81. Except for this, the third fixed example is preferably the same as the first fixed example (see FIG. 7A).

As described above, according to the present preferred embodiment, the forward end of the rigging hose 59 that contains the cables 60 is supported by the stay 66 at the support position 70 that is located in the adjacent region 90 of the clamp bracket 40. The support position 70 does not change depending on the tilt angle of the outboard motor body 20. Therefore, even when the outboard motor body 20 is tilted/trimmed, substantial displacement of the cables 60, which conventionally results from tilting/trimming, on the side of the hull 2 with respect to the support position 70 does not occur. In other words, an influence upon the cables 60 caused by the fact that the outboard motor body 20 is tilted/trimmed is prevented at the support position 70. Additionally, due to the stay 66, the support position 70 of the rigging hose 59 does not change depending on the steering angle in the rightward and leftward directions of the outboard motor body 20. As a result, even when the outboard motor body 20 is steered, substantial displacement of the cables 60, which results from steering of the outboard motor body 60, on the side of the hull 2 with respect to the support position 70 does not occur. In other words, an influence upon the cables 60 caused by the fact that the outboard motor body 20 is steered is prevented at the support position 70.

Therefore, there is no need to provide the hull 2 with a large motor well 10 to accommodate displacement of the rigging hose 59 or the cables 60 resulting from the operation of the outboard motor body 20.

Moreover, in the present preferred embodiment, the adjacent region 90 in which the support position 70 of the cables 60 is located due to the stay 66 is a region defined between the upper surface 2*a* of the hull 2 and the surface 28*b* of the engine cover 28 between the lowest point 91 of the engine cover 28, which is fixed when the outboard motor body 20 is tilted up at the maximum tilt angle, and the tilt axis A4.

As a result, the position of the rigging hose 59 and the position of the cables 60 are fixed very close to the clamp bracket 40, and therefore there is no need for a region for the rigging hose 59 and the cables 60 to move in response to the operation of the outboard motor body 20. This makes it possible to reduce a space (motor well 10) required to accommodate the rigging hose 59 and the cables 60 on the side of the hull 2. This makes it possible to increase the strength of a hull structure, and makes it possible to facilitate the design and production of the hull 2. Additionally, it becomes possible to widen the inboard residence space 11 and to reduce the hull 2 in size. Additionally, there is no need to design the rigging hose 59 and the cables 60 to be longer in consideration of the operation of the outboard motor body 20, and no need for a region for the rigging hose 59 and the cables 60 to move in response to the operation of the outboard motor body 20, and therefore it is possible to provide an outboard motor mounting structure that has good visual quality.

Additionally, in the present preferred embodiment, the support position 70 of the rigging hose 59 is located in front of the clamp bracket 40, and therefore it is not difficult to attach the rigging hose 59 to the stay 66, and therefore it is possible to facilitate the attaching operation of the rigging hose 59, and it is possible to reduce a space for the rigging hose 59 and the cables 60 on the side of the hull 2, and it is possible to provide an outboard motor mounting structure having a good-looking exterior.

Additionally, when a fixed structure (see FIG. 7A) to fix the stay 66 to the clamp bracket 40 is used, there is no need to provide a structure to fix the rigging hose 59 on the side of the hull 2. As a result, it becomes easier to design and produce the hull 2.

Additionally, in the present preferred embodiment, the cables 60 are contained in the rigging hose 59, and the rigging hose 59 is supported by the stay 66. Therefore, it is possible to support many cables 60 together by the stay 66 while containing these cables 60 in the rigging hose 59. This makes it possible to reduce a space for the cables 60 on the side of the hull 2, and makes it possible to provide an outboard motor mounting structure having a good-looking exterior.

Additionally, in the present preferred embodiment, the first cables 61 are supported along the swivel bracket 41 by the first cable guide 71, and the second cables 62 are supported along the swivel bracket 41 by the second cable guide 72. As a result, the cables 60 respond to the operation of the swivel bracket 41 on the side of the outboard motor body 20 with respect to the stay 66. Therefore, the cables 60 respond to the operation of the outboard motor body 20 that turns (tilts/trims) up and down together with the swivel bracket 41. This makes it possible to reliably maintain a connection between the cables 60 and the outboard motor body 20 regardless of the operation of the outboard motor body 20 while supporting the cables 60 by the stay 66 at a fixed support position 70.

Additionally, the first and second cable guides 71 and 72 support the cables 60 so that the cables 60 extend along the swivel bracket 41 in the front-rear direction. As a result, a large load is never imposed on the cables 60 because of the turning (tilting/trimming) in the up-down direction of the swivel bracket 41 or because of the turning (steering) in the left-right direction of the outboard motor body 20 with respect to the swivel bracket 41. Therefore, it is possible to reduce a load imposed on the cables 60 while reliably supporting the cables 60 and while supporting the cables 60 by the stay 66 at a fixed support position 70.

Additionally, in the present preferred embodiment, the cover 81 covers the stay 66 and the rigging hose 59 in front of the engine cover 28. This makes it possible to protect a supported portion of the rigging hose 59 with the cover 81. Besides, it is possible to improve the exterior because the rigging hose 59 and the cables 60 are covered with the cover 81, and hence are not exposed to the outside.

If a structure (see FIG. 7C) in which the stay 66 is fixed to the cover 81 is used, there is no need to provide a structure to individually mount the cover 81 and the stay 66 on the hull 2, and therefore it is possible to simplify the structure of the hull 2, and, accordingly, it becomes easy to design and produce the hull 2.

Additionally, in the present preferred embodiment, the cover 81 does not change its relative position with respect to the clamp bracket 40 depending on the tilt angle of the outboard motor body 20. Therefore, there is no need to provide the inside of the hull 2 with a large space for the cover 81 to move. Therefore, it is possible to simplify the structure of the hull 2, and, accordingly, it becomes easy to design and produce the hull 2.

The cover 81 includes the openings 81*a* and 81*b* through which the cables 60 pass at a lower portion and at a rear portion of the cover 81, respectively. This makes it possible to insert the rigging hose 59 into the cover 81 from the hull 2 through the opening 81*a* in the lower portion of the cover 81. Additionally, this makes it possible to pull the cables 60 toward the outboard motor body 20 through the opening 81*b* in the rear portion of the cover 81.

Additionally, in the present preferred embodiment, the engine cover 28 includes the openings 67 and 68, through which the cables 60 are inserted into its inside, at the lower surface 28*a*. Therefore, it is possible to insert the cables 60 into the inside of the engine cover 28 upwardly from the lower surface 28*a* of the engine cover 28. This makes it possible to make the length of the cables 60 from the region 90 adjacent to the clamp bracket 40 to the engine cover 28 shorter than in a structure in which the cables are inserted from the side surface of the engine cover 28 in the horizontal direction. Additionally, the cables 60 do not protrude from the side surface of the engine cover 28, and therefore the movement of the cables 60 in response to the turning of the outboard motor body 20 in the up-down direction or in the left-right direction is inconspicuous, and it is also possible for the movable range of the cables 60 to be within the movable range of the outboard motor body 20. This makes it possible to exclude a space for the movement of the cables 60 in response to the movement of the outboard motor body 20, and makes it possible to improve the exterior.

Additionally, in the present preferred embodiment, the rising portion 75*c* of the first cable guide 71 covers the cables 60 in front of the opening 67 of the engine cover 28. This makes it possible to reliably protect the cables 60, and makes it possible to render the cables 60 more inconspicuous, and hence makes it possible to improve the exterior.

Additionally, in the present preferred embodiment, the engine cover 28 includes the downward extending wall 80 that protrudes downwardly in front of the opening 67 and that prevents the opening 67 from being exposed. As a result, the opening 67 and the cables 60 become even more inconspicuous, and therefore it is possible to improve the exterior, and it is possible to protect the cables 60 and the internal structure of the engine cover 28.

Figure 8:
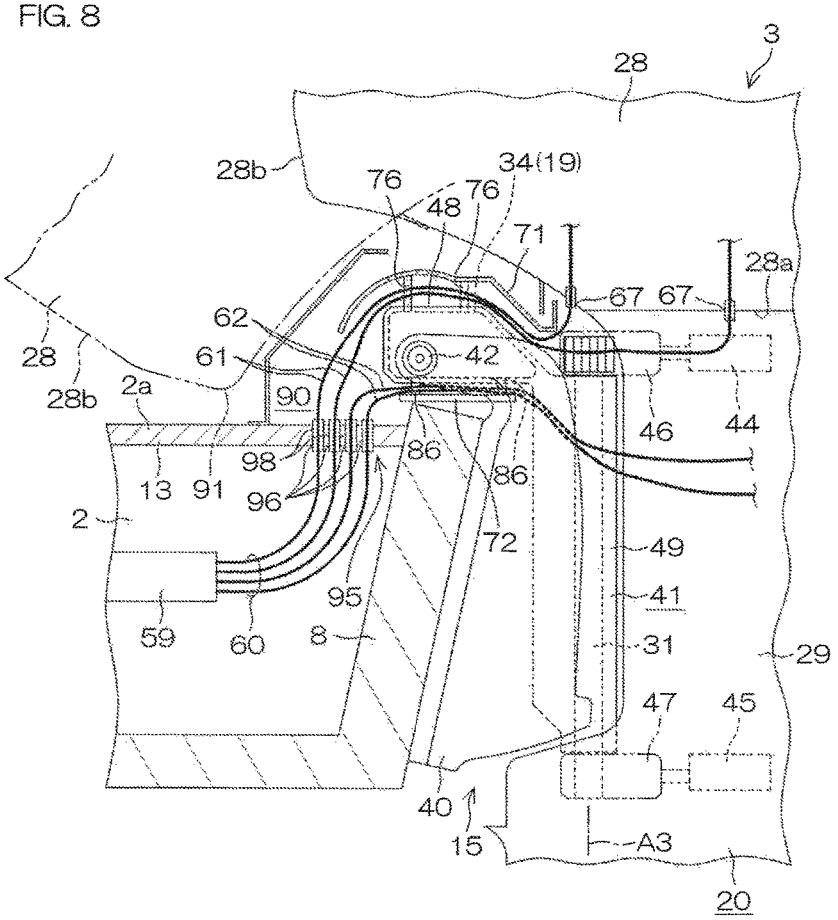
FIG. 8 is a cross-sectional view showing another preferred embodiment of the present invention, in which the cables are supported at a support position on the upper surface of the hull.

FIG. 8 is a cross-sectional view showing another preferred embodiment of the present invention, in which the cables 60 are supported at a support position 95 located on the upper surface 2*a* of the hull 2. In this example, the entirety of the rigging hose 59 is contained in the hull 2. The cables 60 extend out from the forward end of the rigging hose 59 in the hull 2, and upwardly from the upper surface 2*a* of the hull 2 through a through-hole 96 in the ceiling wall 13 of the motor well 10. In the example of FIG. 8, a plurality of through-holes 96 are provided, and one cable or a plurality of cables 60 pass through each through-hole 96. A waterproof component 98, such as a rubber bushing, is disposed in each through-hole 96, and the cables 60 are inserted into and pass through the waterproof component 98. Therefore, the ceiling wall 13 and the waterproof component 98 are examples of the first connector support that supports the cables 60 at the support position 95 located in the adjacent region 90.

The first cables 61 among the cables 60 extend upwardly from the upper surface 2*a* of the hull 2 (i.e., the upper surface of the ceiling wall 13) and extend rearwardly along the upper surface 34*a* of the steering housing 34. The second cables 62 extend rearwardly along the lower surface 34*b* of the steering housing 34.

Likewise, the relative position of the support position 95 with respect to the clamp bracket 40 does not change. Additionally, the support position 95 is in the adjacent region 90 defined between the lowest point 91 of the engine cover 28 being in a tilted-up state and the tilt axis A4 and between the surface of the engine cover 28 being in a tilted-up state and the upper surface 2*a* of the hull 2. Particularly in this example, the support position 95 is located on the upper surface 2*a* of the hull 2. In this example, the cables 60 are supported by the upper surface 2*a* of the hull 2, and therefore it is possible to simplify the support structure of the cables 60.

Although preferred embodiments of the present invention have been described above, the present invention can be embodied in still other preferred embodiments and structural configurations as described hereinafter.

A structure in which the cables 60 are supported at the support positions 70 and 95 of the adjacent region 90 of the clamp bracket 40 may be excluded. In this case, the rigging hose 59 and the cables 60 are moved in the motor well 10 by tilting/trimming and steering the outboard motor body 20. Therefore, the rigging hose 59 and/or the cables 60 exposed from the upper surface 2*a* of the hull 2 (i.e., the upper surface of the ceiling wall 13) are beforehand covered with the cover 81. As a result, even if the rigging hose 59 and/or the cables 60 move in response to the movement of the outboard motor body 20, their moving range is limited by the cover 81. Therefore, it becomes unnecessary to provide the hull 2 with a large space (motor well 10) when considering the displacement of the cables 60 caused by the operation of the outboard motor body 20. This makes it possible to increase the strength of a hull structure, and makes it possible to facilitate the design and production of the hull 2. Additionally, it becomes possible to widen the inboard residence space 11 and to reduce the hull 2 in size. Moreover, the movement of the cables 60 resulting from the operation of the outboard motor body 20 is not seen, and therefore it is possible to provide an outboard motor mounting structure that has good visual quality.

In the above preferred embodiments, the first and second cable guides 71 and 72 are preferably fixed to the swivel bracket 41 through the steering housing 34. However, the first and second cable guides 71 and 72 may be fixed directly to the swivel bracket 41.

In the above preferred embodiments, an electrically-operated steering device 19 is preferably used. However, a hydraulic oil steering device may be used instead. The hydraulic oil steering device may be an electric device that includes an electric pump, or may be a manual device operated by a cable that transmits the operating force of the steering wheel 6. The steering device is not required to be located between the pair of clamp brackets 40, and may be located in front of the clamp brackets 40.

Although an example in which the first and second cable guides 71 and 72 are preferably plate-shaped cable guides has been described in the above preferred embodiments, for example, tubular cable guides that extend in the front-rear direction may be used instead of the plate-shaped cable guides.

Although an example in which the cover 81 is preferably fixed to the ceiling wall 13 of the motor well 10 has been described in the above preferred embodiments, the cover 81 may be attached to the clamp bracket 40. If so, it becomes unnecessary to provide the hull with a structure to attach the cover 81, and therefore it is possible to simplify the structure of the hull 2, and, accordingly, it becomes easy to design and produce the hull 2.

In the above preferred embodiments, the first cable guide 71 includes the rising portion 75*c* with which the front portion of the opening 67 of the engine cover 28 is covered. However, the rising portion 75*c* may be excluded, and a second cover similar to the rising portion 75*c* may be provided separately from the first cable guide 71.

In a preferred embodiment of the present invention described above, the entirety of the rigging hose 59 is preferably covered with the cover 81 above the upper surface 2*a* of the hull 2 (the upper surface of the ceiling wall 13 of the motor well 10). However, a portion of the rigging hose 59 is not necessarily required to be covered with the cover 81. For example, the rigging hose may extend rearwardly from the front wall 14 (see FIG. 1) of the motor well 10, and this rigging hose may be inserted into the cover 81 through a sidewall 81*c* (see FIG. 3A) of the cover 81. In this case, it is preferable to provide an opening or a cutout 81*d* (which is shown in FIG. 3A by the alternate long and two short dashes line) through which the rigging hose passes in the sidewall 81*c*.

The present application corresponds to Japanese Patent Application No. 2015-221419 filed in the Japan Patent Office on Nov. 11, 2015, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor mounting structure to mount an outboard motor body including an engine and an engine cover on a hull, the outboard motor mounting structure comprising:

a mounting bracket able to be fixed to the hull;

a swivel bracket joined to the mounting bracket to be tiltable around a tilt axis and able to support the outboard motor body;

a flexible connector that includes at least one of a wire, an operating cable, and a pipe to connect a piece of equipment provided on the hull and a piece of equipment provided in the outboard motor body; and a first connector support that supports the flexible connector at a support position in a region adjacent to the mounting bracket, a relative position of the support position with respect to the mounting bracket not changing depending on a tilt angle of the outboard motor body; wherein the adjacent region is defined as a region between an upper surface of the hull and the engine cover in a state that the outboard motor body is tilted up at a maximum tilt angle, and between a lowest point of the engine cover in the state that the outboard motor body is tilted up at the maximum tilt angle and the tilt axis.

2. The outboard motor mounting structure according to claim 1, wherein the first connector support supports the flexible connector at the support position in front of the mounting bracket.

3. The outboard motor mounting structure according to claim 1, wherein the first connector support includes a stay fixed to the mounting bracket.

4. The outboard motor mounting structure according to claim 1, wherein the first connector support supports the flexible connector at the upper surface of the hull.

5. The outboard motor mounting structure according to claim 1, further comprising a hose that contains the flexible connector; wherein the first connector support supports the hose.

6. The outboard motor mounting structure according to claim 1, further comprising a second connector support that supports the flexible connector along the swivel bracket.

7. The outboard motor mounting structure according to claim 6, wherein the second connector support supports the flexible connector so that the flexible connector extends along the swivel bracket in a front-rear direction of the hull.

8. The outboard motor mounting structure according to claim 1, further comprising a first cover that covers the first connector support and the flexible connector in front of the engine cover.

9. The outboard motor mounting structure according to claim 8, wherein the first connector support includes a stay fixed to the first cover.

10. The outboard motor mounting structure according to claim 8, wherein the first cover is disposed so that a relative position with respect to the mounting bracket does not change depending on the tilt angle of the outboard motor body.

11. The outboard motor mounting structure according to claim 1, wherein the engine cover includes a lower surface including an opening through which the flexible connector is inserted.

12. The outboard motor mounting structure according to claim 11, further comprising a second cover with which the flexible connector is covered in front of the opening.

13. The outboard motor mounting structure according to claim 11, wherein the engine cover includes a downwardly extending wall that protrudes downwardly in front of the opening and that prevents the opening from being exposed.

14. An outboard motor mounting structure to mount an outboard motor body including an engine and an engine cover on a hull, the outboard motor mounting structure comprising:

a mounting bracket able to be fixed to the hull;

a swivel bracket joined to the mounting bracket to be tiltable around a tilt axis and able to support the outboard motor body;

a flexible connector that includes at least one of a wire, an operating cable, and a pipe to connect a piece of equipment provided on the hull and a piece of equipment provided in the outboard motor body; and a first cover disposed in front of the engine cover and that extends rearward toward the engine cover to cover the flexible connector, a relative position of the first cover with respect to the mounting bracket not changing depending on a tilt angle of the outboard motor body; wherein the engine cover includes a lower surface including an opening through which the flexible connector is inserted; and the engine cover includes a downwardly extending wall that protrudes downwardly in front of the opening and that prevents the opening from being exposed.

15. The outboard motor mounting structure according to claim 14, wherein the first cover includes openings through which the flexible connector extends at a lower portion of the first cover and at a rear portion of the first cover, respectively.

16. The outboard motor mounting structure according to claim 14, further comprising a second cover with which the flexible connector is covered in front of the opening.

17. An outboard motor vessel comprising:

a hull;

an outboard motor body that includes an engine and an engine cover with which the engine is covered; and an outboard motor mounting structure that mounts the outboard motor body on the hull, the outboard motor mounting structure including:

a mounting bracket fixed to the hull;

a swivel bracket joined to the mounting bracket to be tiltable around a tilt axis and that supports the outboard motor body;

a flexible connector that includes at least one of a wire, an operating cable, and a pipe to that connects a piece of equipment on the hull and a piece of equipment provided in outboard motor body; and a first connector support that supports the flexible connector at a support position in a region adjacent to the mounting bracket, a relative position of the support position with respect to the mounting bracket not changing depending on a tilt angle of the outboard motor body; wherein the adjacent region is defined as a region between an upper surface of the hull and the engine cover in a state that the outboard motor body is tilted up at a maximum tilt angle, and between a lowest point of the engine cover in the state that the outboard motor body is tilted up at the maximum tilt angle and the tilt axis.

* * * * *